US006870521B2

(12) United States Patent
Iwami

(10) Patent No.: US 6,870,521 B2
(45) Date of Patent: Mar. 22, 2005

(54) METHOD AND DEVICE FOR DRIVING PLASMA DISPLAY PANEL

(75) Inventor: Takashi Iwami, Yamanashi (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 240 days.

(21) Appl. No.: 10/314,256

(22) Filed: Dec. 9, 2002

(65) Prior Publication Data

US 2003/0137471 A1 Jul. 24, 2003

(30) Foreign Application Priority Data

Jan. 22, 2002 (JP) ..... 2002-012414

(51) Int. Cl.[7] ..... G09G 3/28; G09G 3/20; G09G 3/10

(52) U.S. Cl. ..... 345/60; 345/55; 345/41

(58) Field of Search ..... 345/41, 55, 60, 345/62, 63, 66, 67, 68; 315/160–176

(56) References Cited

U.S. PATENT DOCUMENTS 4,349,819 A * 9/1982 Terakawa ..... 345/211
5,943,032 A * 8/1999 Nagaoka et al. ..... 345/63
5,973,655 A * 10/1999 Fujisaki et al. ..... 345/63
6,614,413 B2 * 9/2003 Tokunaga et al. ..... 345/63
6,724,356 B1 * 4/2004 Kojima et al. ..... 345/60
6,816,135 B2 * 11/2004 Ide et al. ..... 345/60

* cited by examiner

*Primary Examiner*—Vijay Shankar
(74) *Attorney, Agent, or Firm*—Morgan, Lewis & Bockius LLP

(57) ABSTRACT

The present invention provides a plasma display driving method and driving device which can improve image display contrast. The method comprises an address step for shifting the discharge cells into an emission enable state when the discharge cells corresponding to each pixel of the plasma display panel are in an emission disable state, by selectively causing the discharge cells to perform a selective writing discharge in accordance with the pixel data of each pixel, based on a video signal, thus generating wall charges in the discharge cells; and, on the other hand, when the discharge cells are in an emission enable state, shifting the discharge cells into an emission disable state by selectively causing the discharge cells to perform a selective erasing discharge in accordance with the pixel data, thus erasing the wall charges in the discharge cells; and an emission sustain step for causing only those discharge cells which are in the emission enable state to emit light repeatedly.

8 Claims, 7 Drawing Sheets

FIG. 6

| | CONVERSION TABLE OF DRIVE DATA GENERATION CIRCUIT 2 | | 1-FIELD EMISSION PATTERN | | | | |
|---|---|---|---|---|---|---|---|
| LUMINANCE | PD | GD 1 23 45 67 89 | SF1 | SF2 | SF3 | SF4 | SF5 |
| 0 | 00000 | 1 00 00 00 00 | ● | | | | |
| 1 | 00001 | 0 01 00 00 00 | ○ | ● | | | |
| 2 | 00010 | 1 10 01 00 00 | ● | ◎ | ● | | |
| 3 | 00011 | 0 00 01 00 00 | ○ | ○ | ● | | |
| 4 | 00100 | 1 00 10 01 00 | ● | | ◎ | ● | |
| 5 | 00101 | 0 01 10 01 00 | ○ | ● | ◎ | ● | |
| 6 | 00110 | 1 10 00 01 00 | ● | ◎ | ○ | ● | |
| 7 | 00111 | 0 00 00 01 00 | ○ | ○ | ○ | ● | |
| 8 | 01000 | 1 00 00 10 01 | ● | | | ◎ | ● |
| 9 | 01001 | 0 01 00 10 01 | ○ | ● | | ◎ | ● |
| 10 | 01010 | 1 10 01 10 01 | ● | ◎ | ● | ◎ | ● |
| 11 | 01011 | 0 00 01 10 01 | ○ | ○ | ● | ◎ | ● |
| 12 | 01100 | 1 00 10 00 01 | ● | | ◎ | ○ | ● |
| 13 | 01101 | 0 01 10 00 01 | ○ | ● | ◎ | ○ | ● |
| 14 | 01110 | 1 10 00 00 01 | ● | ◎ | ○ | ○ | ● |
| 15 | 01111 | 0 00 00 00 01 | ○ | ○ | ○ | ○ | ● |
| 16 | 10000 | 1 00 00 00 10 | ● | | | | ◎ |
| 17 | 10001 | 0 01 00 00 10 | ○ | ● | | | ◎ |
| 18 | 10010 | 1 10 01 00 10 | ● | ◎ | ● | | ◎ |
| 19 | 10011 | 0 00 01 00 10 | ○ | ○ | ● | | ◎ |
| 20 | 10100 | 1 00 10 01 10 | ● | | ◎ | ● | ◎ |
| 21 | 10101 | 0 01 10 01 10 | ○ | ● | ◎ | ● | ◎ |
| 22 | 10110 | 1 10 00 01 10 | ● | ◎ | ○ | ● | ◎ |
| 23 | 10111 | 0 00 00 01 10 | ○ | ○ | ○ | ● | ◎ |
| 24 | 11000 | 1 00 00 10 00 | ● | | | ◎ | ○ |
| 25 | 11001 | 0 01 00 10 00 | ○ | ● | | ◎ | ○ |
| 26 | 11010 | 1 10 01 10 00 | ● | ◎ | ● | ◎ | ○ |
| 27 | 11011 | 0 00 01 10 00 | ○ | ○ | ● | ◎ | ○ |
| 28 | 11100 | 1 00 10 00 00 | ● | | ◎ | ○ | ○ |
| 29 | 11101 | 0 01 10 00 00 | ○ | ● | ◎ | ○ | ○ |
| 30 | 11110 | 1 10 00 00 00 | ● | ◎ | ○ | ○ | ○ |
| 31 | 11111 | 0 00 00 00 00 | ○ | ○ | ○ | ○ | ○ |

◎ : EMISSION (SELECTIVE WRITING)
○ : MISSION (SELECTIVE ERASING · NO WRITING)
● : EXTINCTION (SELECTIVE ERASING)
BLANK : EXTINCTION (SELECTIVE ERASING · NO WRITING)

METHOD AND DEVICE FOR DRIVING PLASMA DISPLAY PANEL

BACKGROUND OF THE INVENTION

1. Field of the Invention

The present invention relates to a method and device for driving plasma display panel.

2. Description of the Related Art

In recent years, to meet the increasing demand for thin-shape display panels as a result of widespread use of large screen display apparatus, various types of thin display panels have been realized. AC discharge type plasma display panels are one kind of flat panel display that has received considerable attention.

FIG. 1 is a schematic diagram of the construction of a plasma display apparatus comprising such a plasma display panel and a driving device for driving the same.

As shown in FIG. 1, the plasma display panel PDP 10 has m column electrodes $D_1$ to $D_m$ which are intersected by n row electrodes $X_1$ to $X_n$ and n row electrodes $Y_1$ to $Y_n$ arranged so as to intersect to the former. A pair of these row electrodes $X_1$ to $X_n$ and $Y_1$ to $Y_n$ comprising one row electrode $X_i$ ($1 \leqq i \leqq n$) and one row electrode $Y_i$ ($1 \leqq i \leqq n$) correspond to a display line in the PDP 10. The row electrodes X and Y are arranged so as to intersect the column electrodes D, with a discharge space in between enclosing the discharge gas; the discharge cells corresponding to the pixels are formed in each point of intersection of the row electrode pairs and the column electrodes comprising this discharge space.

The discharge cells, which are light-emitting elements using discharge phenomena, can each be placed in only one of two states, i.d, light-on state and light-off state. That is, each of the discharge cells only displays luminance with two gradation levels, a minimum luminance (light-off state) and a maximum luminance (light-on state).

In the PDP 10 with such discharge cells, the driving device 100 carries out the gradation driving for implementing the halftone according to an input video signal by means of the subfield method. In the subfield method, each field in the input video signal is divided into 5 subfields SF1 to SF5, as shown in FIG. 2. The emission driving is performed in each of the subfields by allocating an emission period corresponding to the weighting of these subfields.

FIG. 3 is a diagram showing each of the driving pulses that the driving device 100 applies to the columns electrodes and row electrode pairs of the above PDP 10, and the respective application timings.

Firstly, in the general reset step $R_c$, the driving device 100 applies a positive reset pulse $RP_x$ to the row electrodes $X_1$ to $X_n$, and a negative reset pulse $RP_y$ to the row electrodes $Y_1$ to $Y_n$. In response to these applied reset pulses $RP_x$ and $RP_y$, all the discharge cells in PDP 10 undergo a reset discharge whereby in each discharge cell a predetermined quantity of wall charges are uniformly built. This way all the discharge cells are initialized into an emission enable state.

Next, in the address step $W_c$, the driving device 100 converts the inputted image signal for each pixel into 5-bit pixel data. It generates pixel data pulses having a pulse voltage corresponding to the logical level of the first bit of this pixel data for subfield SF1, the second bit for SF2, the third bit for SF3, the fourth bit for SF4 and the fifth bit for SF5. For instance, in subfield SF1, the driving device 100 generates a pixel data pulse having a pulse voltage corresponding to the logical level of the first bit of the above pixel data. Herein, if the logical level of the first bit is "1", the driving device 100 generates a pixel data pulse having a high-voltage pulse; if the logical level of the first bit is "0", it generates a pixel data pulse having a low-voltage (0 volt). The driving device 100 sequentially applies these pixel data pulses, to the column electrodes $D_1$ to $D_m$, one display line at a time. That is, firstly, the driving device 100 applies the pixel data pulse group $DP_1$, formed by the m pixel data pulses corresponding to the first display line, to the column electrodes $D_1$ to $D_m$; next it applies the pixel data pulse group $DP_2$, formed by the m pixel data pulses corresponding to the second display line, to the column electrodes $D_1$ to $D_m$. Further, the driving device 100, in synchronization with the application timing of each pixel data pulse group DP, generates negative scanning pulses SP and applies them in succession to the row electrodes $Y_1$ to $Y_n$, as shown in FIG. 3. Now, discharges (selective erasing discharges) take place only in those discharge cells in the intersection points of the column electrodes to which high-voltage pixel data pulses have been applied and the display lines to which the scanning pulses SP have been applied, whereby the wall charges formed inside the discharge cells erase. Thus the discharge cells initialized into an emission enable state in the above general reset step $R_c$ change to a state wherein they cannot emit (hereinafter referred to as the emission disable state) in the emission sustain step $I_c$ described below. On the other hand, although they have been applied a scanning pulse SP, the above selective erasing discharge does not occur in the discharge cells having been applied a low-voltage pixel data pulse, and they continue in the initialized state as per the above general reset step $R_c$, that is, in an emission enable step.

So, by means of the address step $W_c$, either one or the other of the following states is set for each of the discharge cells in PDP 10 in response to pixel data corresponding to an input pixel data; either an emission enable state in the emission sustain step $I_c$, or an emission disable state in the emission sustain step $I_c$.

Further, in the address step $W_c$, the driving device 100 sequentially applies positive priming pulses PP to the row electrodes $Y_1$ to $Y_n$ immediately preceding the scanning pulses SP, as shown in FIG. 3. By applying these priming pulses, a priming discharge is made to occur in the discharge cells in order for priming particles to form in the discharge spaces. Thus, in order for the selective erasing discharge to be effectively carried out, sufficient priming particles are left in the discharge spaces of each discharge cell prior to the selective erasing discharge.

Next, in the emission sustain step $I_c$, the driving device 100 repeatedly applies positive sustain pulses $IP_x$ and $IP_y$ to the row electrodes $X_1$ to $X_n$ and $Y_1$ to $Y_n$ throughout the period allocated in each of the above subfields. Now, only those discharge cells in whose discharge space a residual wall charge remains, i.e. those cells in an emission enable state, discharge (sustain discharge) whenever they are applied these sustain pulses $IP_x$ and $IP_y$. That is, only those discharge cells where no selective erasing discharge occurred in the above address step $W_c$ maintain their emission state by repeating the emission brought about by the above sustain discharge, throughout the period allocated in each of the above subfields.

Then, in the erasing step E, the driving device 100 applies simultaneously an erasing pulse EP to the row electrodes $Y_1$ to $Y_n$, as shown in FIG. 3. By applying this erasing pulses EP, an erasing discharge is made to take place in all the discharge cells of PDP 10, thereby erasing the remaining wall charges in the discharge cells.

The above general reset step $R_c$, address step $W_c$, emission sustain step $I_c$ and erasing step E are performed in succession for each of the subfields SF1 to SF5 shown in FIG. 2. By means of such driving, emission is achieved through the sustain discharges extending through the emission periods corresponding to the luminance level of the input video signal, wherein luminance is perceived in accordance with those emission periods. In this case, for the subfields SF1 to SF5 shown in FIG. 2, there are $5^2=32$ possible subfield combination patterns for causing emission, with a different total sum of emission periods per subfield. By means of a drive based on these 5 subfields SF1 to SF5, therefore, an intermediate luminance of 32 gradation levels can be displayed.

However, in the drive scheme described above, problems of low image display contrast arise, since the discharges for emission are made to occur in each subfield without any reference to the display image, like the above reset discharge and erasing discharge.

SUMMARY OF THE INVENTION

An object of the present invention is to provide a plasma display panel driving method and driving device capable of increasing display image contrast.

The plasma display panel driving method according to the present invention is a plasma display panel driving method for driving a plasma display panel in which discharge cells bearing pixels are formed at each intersection point of a plurality of row electrodes corresponding to display lines and a plurality of column electrodes arranged so as to intersect said row electrodes, by the unit of a plurality of subfields constituting each field of a video signal, said method comprising:

an address step for setting each said discharge cell in accordance with the pixel data of each pixel based on said video signal either in an emission enable state or an emission disable state, for each said subfield; and an emission sustain step for causing only said discharge cells in said emission enable state to emit light repeatedly, wherein said address step comprises a step for, when said discharge cells are in said emission disable state, shifting said discharge cells to an emission enable state by selectively causing said discharge cells to perform a selective writing discharge in accordance with said pixel data, thus generating wall charges in said discharge cells; and, on the other hand, when said discharge cells are in said emission enable state, shifting said discharge cells to an emission disable state by selectively causing said discharge cells to perform a selective erasing discharge in accordance with said pixel data, thus erasing the wall charges in said discharge cells.

Also, the plasma display panel driving device according to the present invention is a plasma display panel driving device for driving a plasma display panel in which discharge cells bearing pixels are formed at each intersection point of a plurality of row electrodes corresponding to display lines and a plurality of column electrodes arranged so as to intersect said row electrodes, by the unit of a plurality of subfields constituting each field of a video signal, comprising:

an address component for setting each of said discharge cells either in an emission enable state or an emission disable state in accordance with the pixel data of each pixel based on said video signal, for each said subfield; and an emission sustain component for causing said discharge cells to emit light repeatedly in said emission enable state, wherein, when said discharge cells are in said emission disable state, said address component shifts said discharge cells to an emission enable state by selectively causing said discharge cells to perform a selective writing discharge in accordance with said pixel data, thus generating wall charges in said discharge cells; and, on the other hand, when said discharge cells are in said emission enable state, said address component causes said discharge cells to shift to an emission disable state by selectively causing said discharge cells to perform a selective erasing discharge in accordance with said pixel data, thus erasing the wall charges in said discharge cells.

BRIEF DESCRIPTION OF THE DRAWINGS

FIG. 6 is a diagram showing the conversion table and emission drive patterns for the driving data generation circuit 2.

DESCRIPTION OF THE PREFERRED EMBODIMENTS

An embodiment of the present invention will be explained in below with reference to the accompanying drawings.

Figure 4:
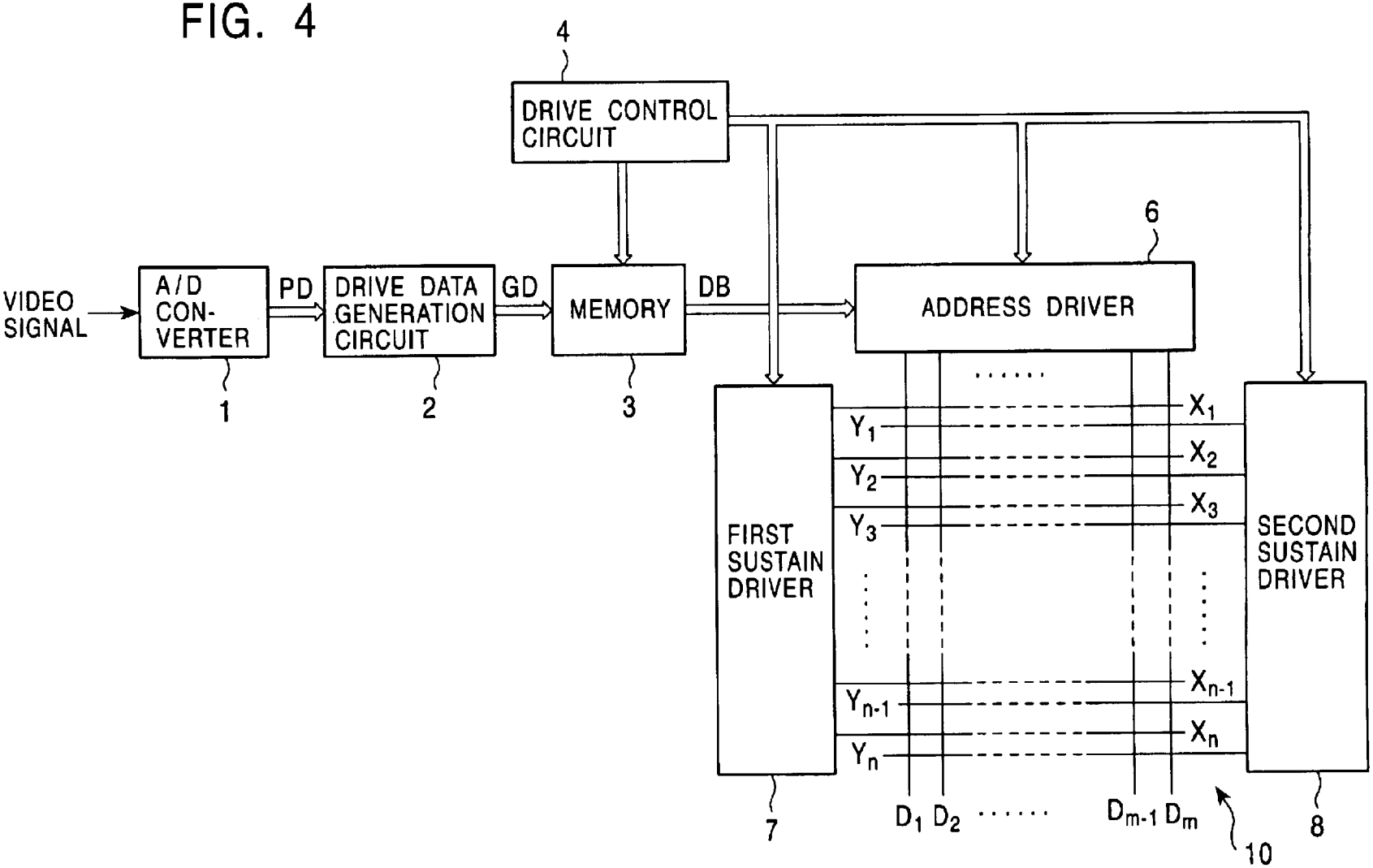
FIG. 4 is a diagram showing the schematic construction of a plasma display device for driving a plasma display panel by means of the driving method according to the present invention.

FIG. 4 is a diagram showing the schematic construction of a plasma display device for driving a plasma display panel by means of the driving method according to the present invention.

Figure 5:
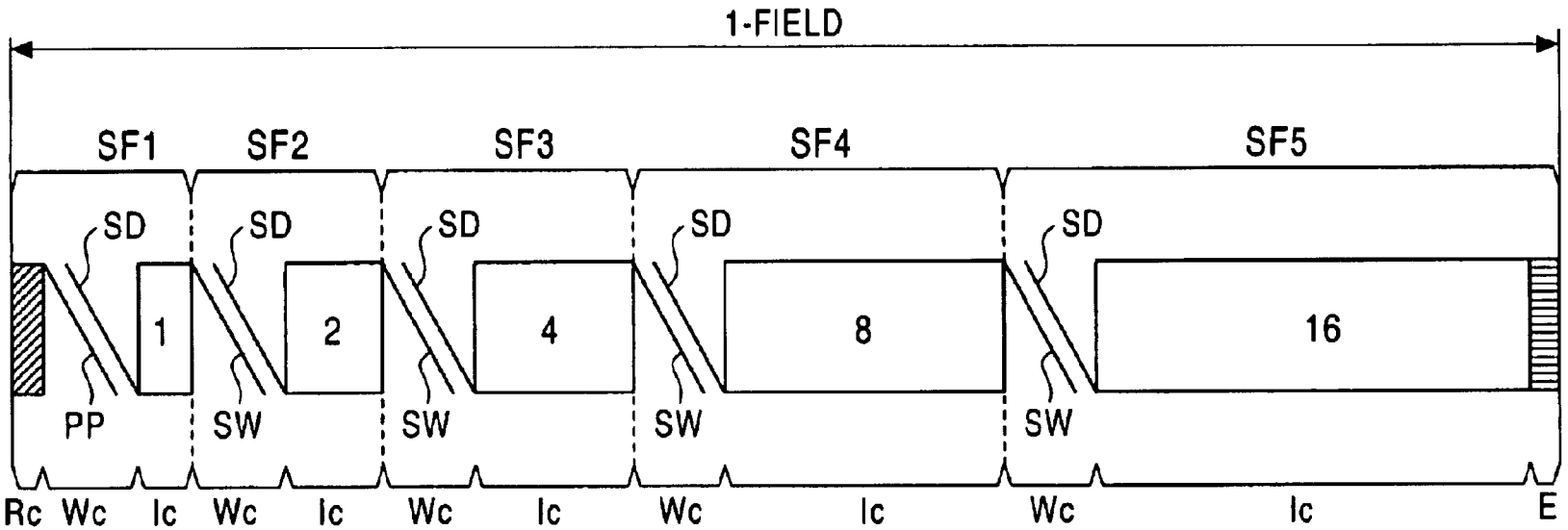
FIG. 5 is a diagram showing an embodiment of the emission drive format used in the drive control circuit 4 of the plasma display device shown in FIG. 4.

The plasma display device comprises a plasma display panel PDP 10 and a drive component 10 for the gradation driving of the PDP 10 according to the emission drive format shown in FIG. 5. Further, FIG. 5 shows an embodiment of an emission drive format used for the gradation driving of the PDP 10 based on the subfield method wherein each field in the input video signal is divided into 5 subfields SF1 to SF5.

The PDP 10 comprises m column electrodes $D_1$ to $D_m$, and an arrangement of n row electrodes $X_1$ to $X_n$ and n row electrodes $Y_1$ to $Y_n$ intersecting each column electrode D. These electrodes X1 to Xn and Y1 to Yn form the first to n-th display lines in the PDP 10 by respectively pairing one row electrode $X_i$ ($1 \leqq i \leqq n$) and one row electrode $Y_i$ ($1 \leqq i \leqq n$). A discharge space enclosing the discharge gas is formed between the column electrode D and the row electrodes X and Y; the discharge cells bearing the pixels are formed in each point of intersection of the row electrode pairs and the column electrodes comprising this discharge space.

The drive component comprises an A/D converter 1, a drive data generation circuit 2, a memory 3, a drive control circuit 4, an address driver 6, a first sustain driver 7 and a second sustain driver 8.

The A/D converter 1 converts the luminance level indicated by the input video signal into 5-bit pixel data for each pixel, which it then supplies to the drive data generation circuit 2.

The drive data generation circuit 2 converts the pixel data PD into 9-bit pixel drive data GD, according to the conversion table shown in FIG. 6, which it then supplies to the memory 3.

The memory 3, following a write signal supplied by the drive control circuit 4 sequentially writes the pixel drive data GD supplied by the above A/D converter. Every time the writing of the n×m pixel drive data $GD_{11}$ to $GD_{nm}$ per one screen, i.e. from pixel drive data $GD_{11}$ corresponding to the first row/first column pixel to the pixel drive data $G_{nm}$ corresponding to the n-th row/m-th column pixel is finished, the memory 3 carries out the reading operation described below.

First, during the subfield SF1 of FIG. 5, the memory 3 reads only the first bit of each pixel drive data GD11 to $GD_{nm}$, as the pixel drive data bit $DB1_{11}$ to $DB1_{nm}$, and supplies them to the address driver 6 one display line at a time. Also, during the subfield SF2, the memory 3 reads only the second bit of each pixel drive data $GD_{11}$ to $GD_{nm}$, as the pixel drive data bit $DB2A_{11}$ to $DB2A_{nm}$, and supplies them to the address driver 6 one display line at a time. Further, during the subfield SF2, the memory 3 reads only the third bit of each pixel drive data $GD_{11}$ to $GD_{nm}$, as the pixel drive data bit $DB2B_{11}$ to $DB2B_{nm}$, and supplies them to the address driver 6 one display line at a time. Also, during the subfield SF3, the memory 3 reads only the fourth bit of each pixel drive data $GD_{11}$ to $GD_{nm}$, as the pixel drive data bit $DB3A_{11}$ to $DB3A_{nm}$, and supplies them to the address driver 6 one display line at a time. Further, during the subfield SF3, the memory 3 reads only the fifth bit of each pixel drive data $GD_{11}$ to $GD_{nm}$, as the pixel drive data bit $DB3B_{11}$ to $DB3B_{nm}$, and supplies them to the address driver 6 one display line at a time. Also, during the subfield SF4, the memory 3 reads only the sixth bit of each pixel drive data $GD_{11}$ to $GD_{nm}$, as the pixel drive data bit $DB4A_{11}$ to $DB4A_{nm}$, and supplies them to the address driver 6 one display line at a time. Further, during the subfield SF4, the memory 3 reads only the seventh bit of each pixel drive data $GD_{11}$ to $GD_{nm}$, as the pixel drive data bit $DB4B_{11}$ to $DB4B_{nm}$, and supplies them to the address driver 6 one display line at a time. Also, during the subfield SF5, the memory 3 reads only the eighth bit of each pixel drive data $GD_{11}$ to $GD_{nm}$, as the pixel drive data bit $DB5A_{11}$ to $DB5A_{nm}$, and supplies them to the address driver 6 one display line at a time. Further, during the subfield SF5, the memory 3 reads only the ninth bit of each pixel drive data $GD_{11}$ to $GD_{nm}$, as the pixel drive data bit $DB5B_{11}$ to $DB5B_{nm}$, and supplies them to the address driver 6 one display line at a time.

The drive control circuit 4, according to the emission drive format shown in FIG. 5, supplies any kind of timing signal to the address driver 6, the first sustain driver 7 and the second sustain driver 8 for carrying out the gradation drive of the above PDP 10. In the emission drive format of FIG. 5, an address step $W_c$ and an emission sustain step $I_c$ are performed within each of the 5 subfields SF1 to SF5. Further, a general reset step $R_c$ is performed prior to the above address step $W_c$ only in the first subfield SF1, and an erasing step E is performed at the end of the last subfield SF5 only.

Figure 7:
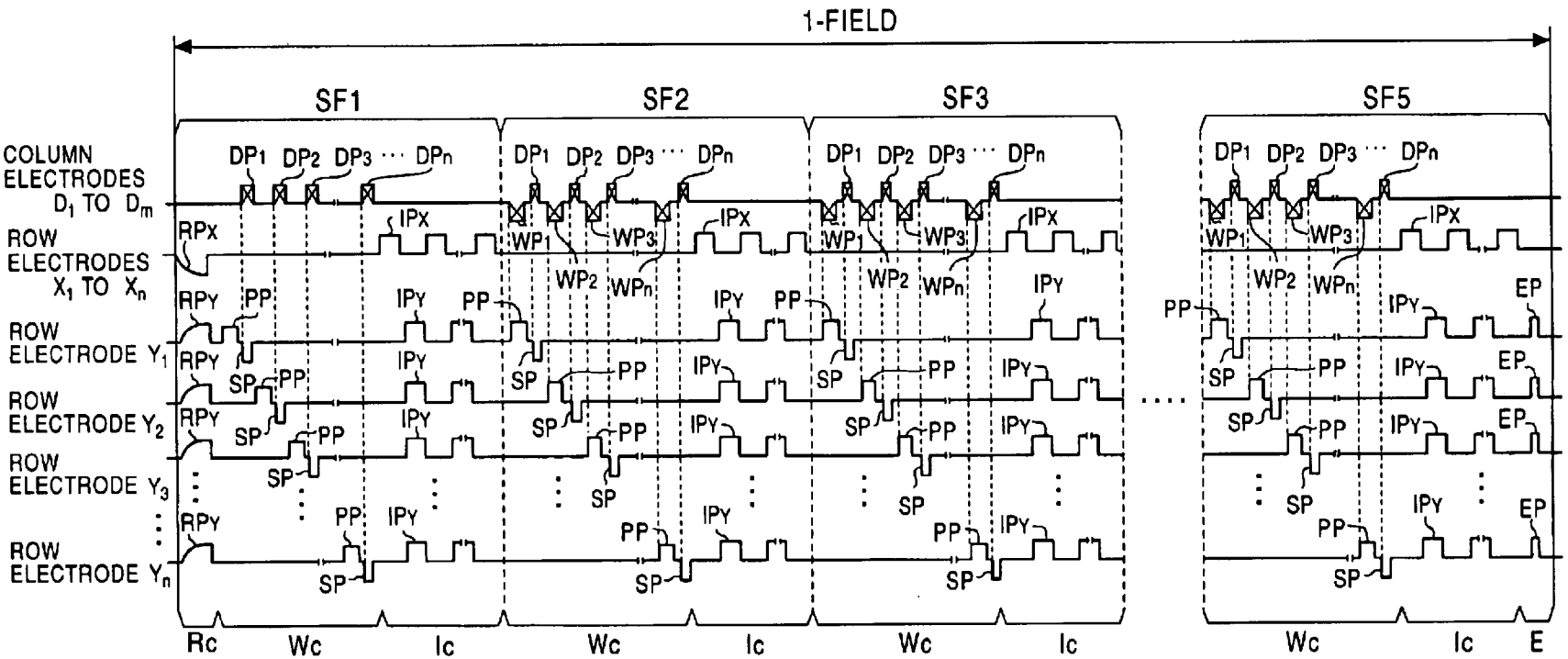
FIG. 7 is a diagram showing each of the driving pulses applied to the column electrodes and row electrodes of the PDP 10 according to the emission drive format shown in FIG. 5, and the respective application timings.

FIG. 7 is a diagram showing each of the various driving pulses that the address driver 6, the first sustain driver 7 and the second sustain driver 8 apply to the PDP 10 according to the various timing signals supplied by the drive control circuit 4, and their respective application timings.

As shown in FIG. 7, first, in the general reset step $R_c$ of the subfield SF1, the first sustain driver 7 generates a positive reset pulse $RP_x$ and applies it to the row electrodes $X_1$ to $X_n$. Simultaneously with this reset pulse $RP_x$, the second sustain driver 8 generates a negative reset pulse $RP_y$ and applies it to the row electrodes $Y_1$ to $Y_n$. In response to these reset pulses $RP_x$ and $RP_y$ applied simultaneously, discharge is made to take place in all the discharge cells of PDP 10 and wall charges form in all the discharge cells. Thereby, all the discharge cells are initialized into a state where emission is possible (emission by sustain discharge) in the emission sustain step $I_c$ described below.

Also, the address step $W_c$ of subfield SF1 comprises a priming step PP and a selective erasing step SD. In the priming step PP, the second sustain driver 8 sequentially applies positive priming pulses to the row electrodes $Y_1$ to $Y_n$, as shown in FIG. 7. By applying these priming pulses PP, a priming discharge is made to take place in each discharge cell, and priming particles form in the discharge spaces. On the other hand, in the selective erasing step SD, the second sustain driver 8 sequentially applies negative scanning pulses SP, immediately after the application of the above priming pulses PP, to the row electrodes $Y_1$ to $Y_n$. Meanwhile, the address driver 6 generates selective erasing data pulses DP having a pulse voltage corresponding of the logical level of the pixel drive data bit DB1 (the first bit of the pixel drive data GD shown in FIG. 6) read from the memory 3, and applies them to the column electrodes in synchronization with the application timing of each scanning pulse SP, one display line (m) at a time. That is, in subfield SF1, the pixel drive data bits $DB_{11}$ to $DB1_{nm}$ are read from the memory 3 and are supplied to the address driver 6. Then, as shown in FIG. 7, the address driver 6 sequentially applies the selective erasing data pulse groups $DP_1, DP_2, DP_3, \ldots, DP_n$, which group the above pixel drive data bits $DB1_1$ to $DB1_{nm}$ per one scanning line, to the column electrodes $D_1$ to $D_m$. Further, if the pixel drive data bit DB1 is of logical level 1, the address driver 6 generates a positive high voltage selective erasing data pulse DP, while if it is of logical level 0 it generates a low voltage selective erasing data pulse DP. Herein, a selective erasing discharge takes place only in those discharge cells in the intersection points of the display lines to which the above scanning pulses SP have been applied and the column electrodes to which the positive high voltage selective erasing data pulses DP have been applied. By means of the above selective erasing discharge, the wall charges formed in the discharge cells erase, and the discharge cells are placed in an emission disable state. On the other hand, the discharge cells to which the above SP scanning pulses have been applied but to which also low voltage selective erasing data pulses DP have been applied do not undergo the selective erasing discharge described above, but continue in the initialized state as per the above general reset step $R_c$, i.e. in an emission enable step.

On the other hand, the address step $W_c$ of each subfield SF2 to SF5 comprises a selective writing step SW and a selective erasing step SD. In the selective writing step SW of each subfield SF2 to SF5, the second sustain driver 8 sequentially applies a positive high voltage priming pulse PP to the row electrodes $Y_1$ to $Y_n$, as shown in FIG. 7. At the same time, the address driver 6 generates selective writing data pulses WP having a pulse voltage corresponding to the logical level of the pixel drive data bit DB supplied from the memory 3, and applies them to the column electrodes $D_1$ to $D_m$, one scanning line (m) at a time, in synchronization with the application timing of the priming pulses PP.

For instance, in the subfield 2, the pixel drive data pulse bits $DB2A_{11}$ to $DB2A_{nm}$ (the second bit of the pixel drive data GD in FIG. 6) are read from the memory 3 and are supplied to the address driver 6. Thus, in the selective writing step SW of the subfield SF2, the address driver applies the selective writing data pulse groups $WP_1$, $WP_2$, $WP_3$, . . . , $WP_n$, which group the selective writing data pulses WP corresponding to each of the above pixel drive data bit $DB2A_{11}$ to $DB2A_{nm}$ per one display line, as shown in FIG. 7. Further, if the pixel drive data bit DB2A is of logical level 1, the address driver 6 generates a negative high voltage selective writing data pulse WP, while if it is of logical level 0, it generates a low voltage selective writing data pulse WP. Herein, a selective writing discharge takes place only in those discharge cells in the intersection points of the display lines to which the above priming pulses PP have been applied and the column electrodes to which the negative high voltage selective writing data pulses WP have been applied. In this case, although priming particles form in the discharge cells as a consequence of the above priming discharge, the wall charges do not form anew as described above. That is, the discharge cells in emission enable state immediately before the above priming discharge continue in the emission enable state, and the discharge cells in emission disable state continue in the emission disable state.

Also, in each of the selective erasing steps SD in the subfields SF2 to SF5, the second sustain driver 8 sequentially applies a negative scanning pulse SP, immediately after the above priming pulse PP, to the row electrodes $Y_1$ to $Y_n$. At the same time, the address driver 6 generates a selective erasing data pulse DP having a pulse voltage corresponding to the logical level of the pixel drive data bit DB supplied from the memory 3, and supplies them to the column electrodes D1 to Dm, one display line (m) at a time, in synchronization with the application timing of the scanning pulses SP.

For instance, in the subfield SF2, the pixel drive data pulse bits $DB2A_{11}$ to $DB2A_{nm}$ and $DB2B_{11}$ to $DB2B_{nm}$ (the third bit of the pixel drive data GD in FIG. 6) are read from the memory 3 and are supplied to the address driver 6. Thus, in the selective erasing step SD of the subfield SF2, the address driver applies the selective erasing data pulse groups $DP_1$, $DP_2$, $DP_3$, . . . , $DP_n$, which group the selective erasing data pulses DP corresponding to each of the above pixel drive data bit $DB2B_{11}$ to $DB2B_{nm}$ per one display line, as shown in FIG. 7. Further, if the pixel drive data bit DB2B is of logical level 1, the address driver 6 generates a positive high voltage selective erasing data pulse DP, while if it is of logical level 0, it generates a low voltage selective erasing data pulse DP. Herein, a selective erasing discharge takes place only in those discharge cells in the intersection points of the display lines to which the above scanning pulses SP have been applied and the column electrodes to which the positive high voltage selective erasing data pulses DP have been applied. By means of the above selective erasing discharge, the wall charges formed in the discharge cells erase, and the discharge cells are placed in an emission disable state. On the other hand, the discharge cells to which the above SP scanning pulses have been applied but to which also low voltage selective erasing data pulses DP have been applied do not undergo the selective erasing discharge described above. Thus, the discharge cells in emission enable state immediately before the above priming discharge are kept in the emission enable state, and the discharge cells in emission disable state are kept in the emission disable state.

Therefore, by means of the address step $W_c$, each discharge cell in each subfield is set in either an emission enable state or an emission disable state, in accordance with the pixel data PD.

Next, in the emission sustain step $I_c$ of each subfield, the first sustain driver 7 and the second sustain driver 8 alternately apply positive sustain pulses $IP_x$ and $IP_y$ to the row electrodes $X_1$ to $X_n$ and $Y_1$ to $Y_n$, as shown in FIG. 7. Herein, if the period for the emission sustain step $I_c$ in the subfield 1 is taken as "1", then the periods of emission sustain step $I_c$ in each subfield SF1 to SF5, that is, the period throughout which the sustain pulses are repeatedly applied, are

SF1:1

SF2:2

SF3:4

SF4:8

SF5:16.

Now, whenever they are applied the above sustain pulses $IP_x$ and $IP_y$, only those discharge cells that retaining unchanged the wall charges, i.e. those discharge cells set in an emission enable state in the address step $W_c$ carried out immediately before the emission sustain step $I_c$, undergo a sustain discharge thus sustaining the emission state result of the sustain discharge throughout the above period.

In the erasing step E of the last subfield SF5, the second sustain driver 8 applies a positive erasing pulse EP to the row electrodes $Y_1$ to $Y_n$. By applying these erasing pulses EP, an erasing discharge is made to occur in all the discharge cells of PDP 10, thereby erasing the residual wall charges in the discharge cells.

Therefore, by means of the drive shown if FIG. 5 to FIG. 7, only those cells set in an emission enable state in the address step $W_c$ of each subfield in accordance with the pixel data PD emit throughout the emission period allocated to that subfield. Herein, the perceived intermediate luminance corresponds to the sum of the emission, periods for the emission extending trough the subfields SF1 to SF5.

An example of the emission operation during one field for a "00101" pixel data indicating a luminance level "5" will be explained below while referring to FIG. 6.

First, in the address step $W_c$ of subfield SF1, since no selective writing or erasing discharge occur, the discharge cells are still in the immediately preceding state, that is the emission enable state initialized in the general reset step $R_c$. Thus, the discharge cells emit during the emission sustain step $I_c$ of the subfield SF1 as indicated by the white circles in FIG. 6. Now, the emission period allocated for the subfield SF1 is "1", so the discharge cells emit throughout the period "1" in the subfield SF1. Also, in the address step $W_c$ of the subfield SF2, a selective erasing discharge occurs as indicated by the solid circles in FIG. 6, so the discharge cells are set in an emission disable state. Thus, the discharge cells erase during the emission sustain step $I_c$ of subfield 2 as indicated by the solid circles in FIG. 6. Also, in the address step Wc of the subfield SF3, a selective writing discharge occurs as indicated by the double circles in FIG. 6, so the discharge cells are set in an emission enable state. Thus, the discharge cells emit during the emission sustain step $I_c$ of subfield 3 as indicated by the double circles in FIG. 6.

Now, the emission period allocated for the subfield SF3 is "4", so the discharge cells emit throughout the period "4" in the subfield SF3. Also, in the address step $W_c$ of the subfield SF4, a selective erasing discharge occurs as indicated by the solid circles in FIG. 6, so the discharge cells are set in an emission disable state. Thus, the discharge cells erase during the emission sustain step $I_c$ of subfield 4 as indicated by the solid circles in FIG. 6. Then, in the address step Wc of subfield SF5, since neither selective writing nor erasing discharges occur, the discharge cells are still in the immediately preceding state, that is, the emission disable state of SF4 is maintained. Therefore, in the emission sustain step Ic of the subfield SF5 the cells continue to be erased as during the subfield 4. This way, for a "000101" pixel data, the discharge cells emit only during subfields SF1 (emission period "1") and SF3 (emission period "4") among the subfields SF1 to SF5. Therefore, the sum of the emission periods for the emission extending trough the subfields SF1 to SF5 will be "5", and the perceived intermediate luminance will correspond to this sum of periods.

Herein, by means of the 5-bit pixel data described above there are 32 subfield combinations (indicated by the white circles and double circles) for carrying out light emission during one field, as shown in FIG. 6. Further, as the emission periods allocated to each subfield are different form one another, the total emission periods during one field, as per each emission pattern, are likewise different. Thus, by means of the drive described in FIG. 5 to FIG. 7, an intermediate luminance display of 32 gradation levels can be achieved, from the display of luminance "0" to luminance "31".

Now, in the present invention, a general reset discharge takes place for initializing into an emission enable step all the discharge cells by causing all the wall charges to build uniformly, during the first subfield SF1. In each subfield, the discharge cells that are to erase are changed to an emission disable state by causing a selective erasing discharge to take place thereby erasing their wall charges. Thus, after the above reset discharge takes place and until the first selective erasing discharge occurs, the discharge cells in all the subfields are made to emit throughout the periods allocated in their subfields. Herein, in each field, if as a consequence of the above selective erasing discharge a discharge cell having once lost its wall charges is reverted again to an emission enable step within the remaining duration of the subfield, a selective writing discharge is made to occur for that discharge cell. By means of this selective writing discharge, wall charges form again in the discharge cells, and the latter are changed to an emission enable state. In all fields, therefore, after a selective writing discharge takes place and until a selective erasing discharge occurs, the discharge cells in all the existing subfields are made to emit throughout the periods allocated in their subfields.

Figure 1:
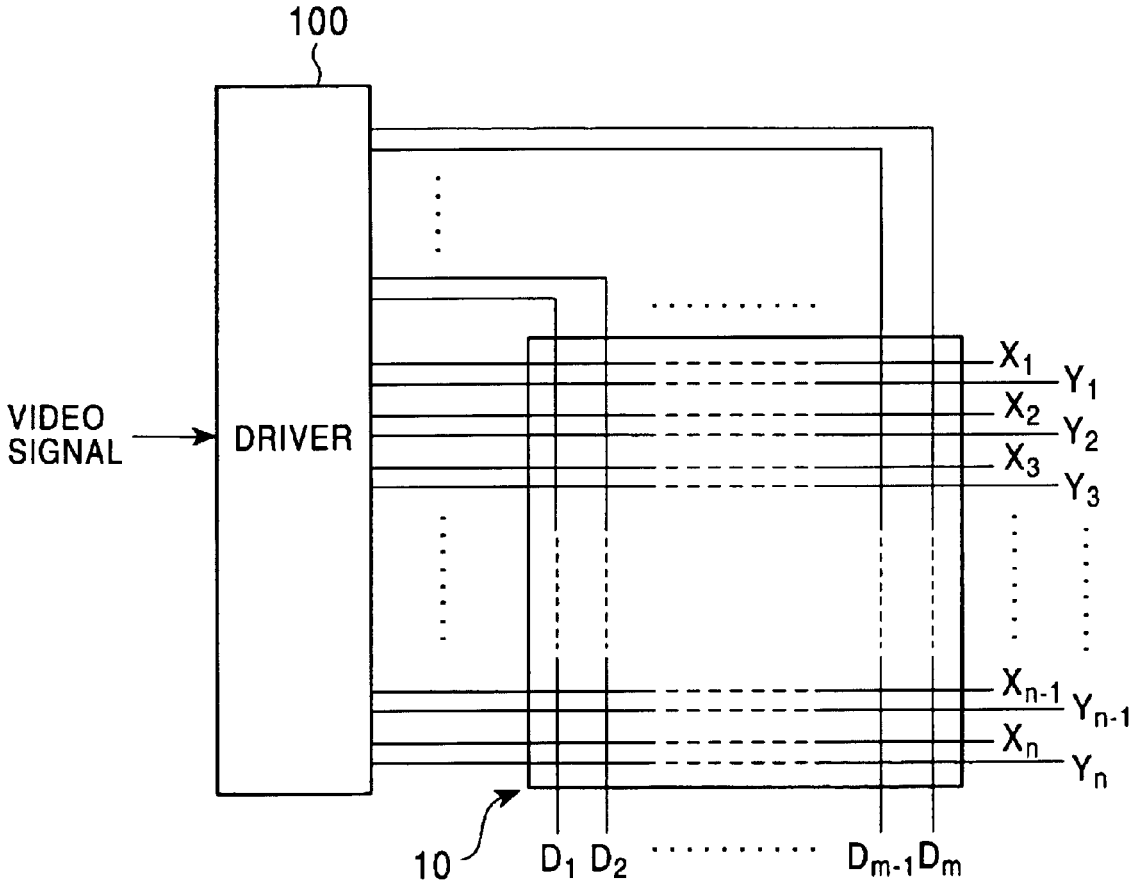
FIG. 1 is a diagram showing the schematic construction of a plasma display device
Figure 2:
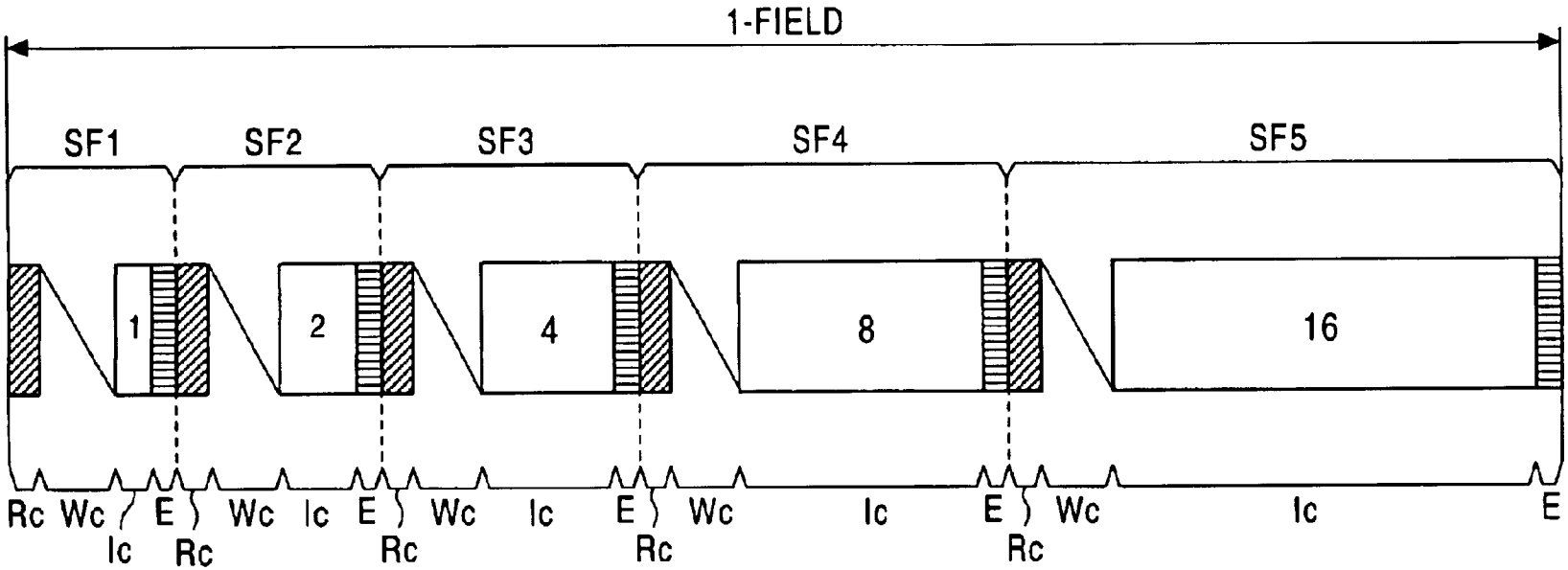
FIG. 2 is a diagram showing an embodiment of an emission drive format based on the subfield method
Figure 3:
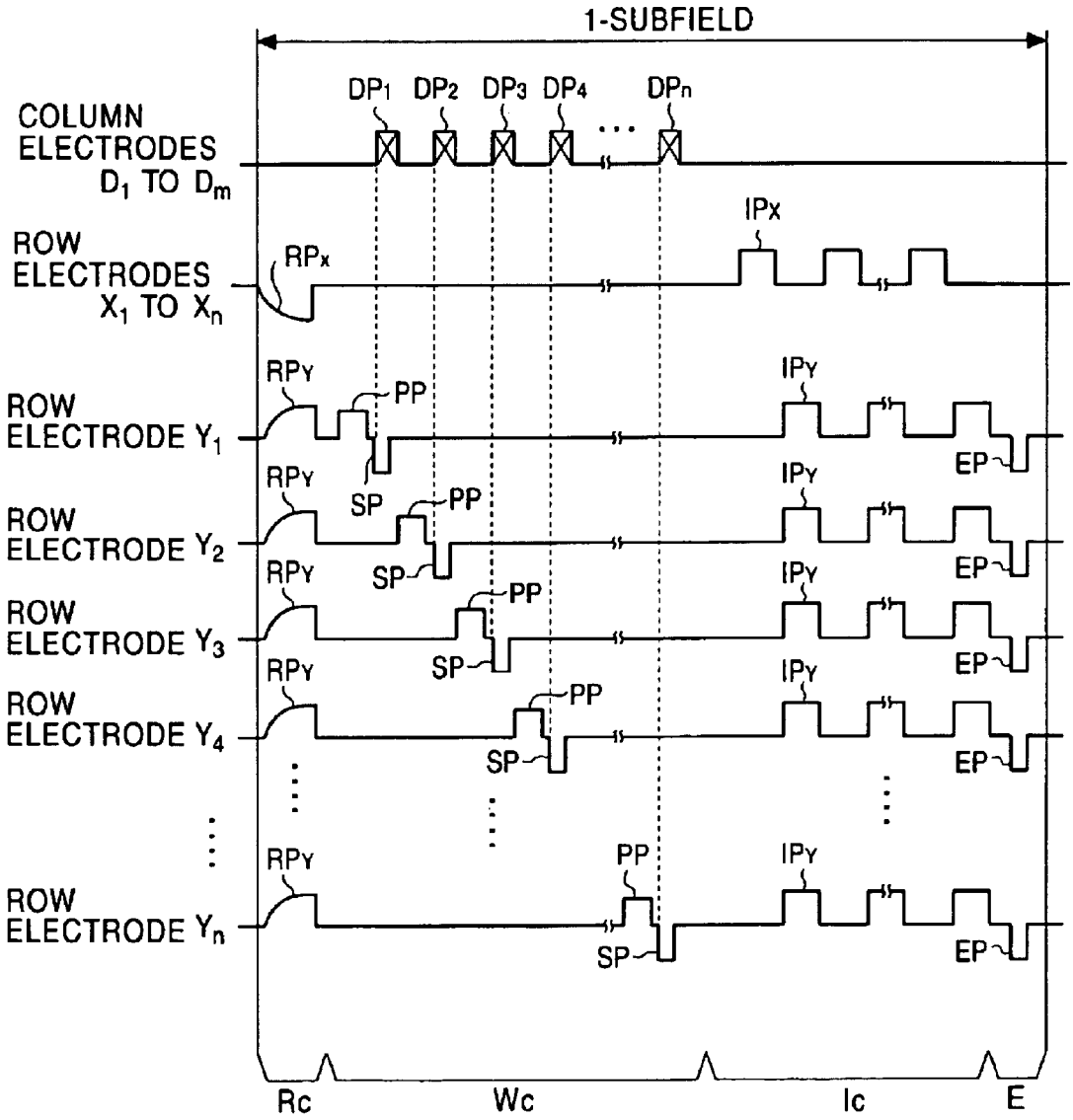
FIG. 3 is a diagram showing each of the driving pulses that the driving device 100 shown in FIG. 1 applies to the column electrodes and row electrodes of the above PDP 10 during a subfield, and the respective application timings.

Thus, by means of the above drive, by simply causing a reset discharge in only the first subfield of each field, wall charges form in all the discharge cells; also, by simply causing an erasing discharge in only the front subfield of each field, wall charges erase in all the discharge cells. Therefore, by means of the present invention, image contrast can be increased in comparison with conventional drives, wherein the above reset discharge and erasing discharge involved in the emission of light are made to occur in each subfield without any reference to the image, as shown in FIG. 2.

Further, in the present invention, the above selective writing discharges are caused to take place using the pulse voltage of the priming pulses applied for forming the priming particles immediately before the selective erasing discharges occur. Thus, sufficient priming particles can form in the discharge spaces of each discharge cell immediately before the selective erasing discharges occur, without having to provide again a period for the selective writing discharges.

As explained above, by means of the plasma display panel driving method of the present invention, a high contrast image display can be attained while ensuring an accurate selective discharge operation based on the input video signal.

This application is based on Japanese Patent Application No. 2002-12414 which is herein incorporated by reference.

What is claimed is:

1. A plasma display panel driving method for driving a plasma display panel, in which discharge cells bearing pixels are formed at intersection points of a plurality of row electrodes corresponding to display lines and a plurality of column electrodes arranged so as to intersect said row electrodes, in a plurality of subfields constituting each field of a video signal, said method comprising:

an address step for setting each said discharge cell in accordance with the pixel data of each pixel based on said video signal either in an emission enable state or an emission disable state, for each said subfield; and an emission sustain step for causing only said discharge cells in said emission enable state to emit light repeatedly, wherein said address step comprises a step for, when said discharge cells are in said emission disable state, shifting said discharge cells to an emission enable state by selectively causing said discharge cells to perform a selective writing discharge in accordance with said pixel data, thus generating wall charges in said discharge cells; and, on the other hand, when said discharge cells are in said emission enable state, shifting said discharge cells to an emission disable state by selectively causing said discharge cells to perform a selective erasing discharge in accordance with said pixel data, thus erasing the wall charges in said discharge cells.

2. The plasma display panel driving method according to claim 1, further comprising:

a reset step for setting all said discharge cells in said emission enable state by performing a reset discharge for all of said discharge cells only in the first subfield among said subfields within the field, immediately before said address step, thus causing the wall charges to be generated in each said discharge cell; and an erasing step for setting all of said discharge cells in said emission disable state by performing an erasing discharge for all of said discharge cells only in the last subfield among said subfields within the field, immediately after said emission sustain step, thus erasing the charges existing in said discharge cells.

3. The plasma display panel driving method according to claim 1, wherein said address step further comprises:

a selective erasing step for imposing said selective erasing discharges by successively applying scanning pulses to each of said row electrodes, and applying, to said column electrodes, selective erasing data pulses having a pulse voltage in accordance with said pixel data, in synchronization with the application timing of each of said scanning pulses; and a selective writing step for imposing said selective writing discharges by successively applying priming pulses to each of said row electrodes, immediately preceding the application of each said scanning pulse, and applying, to said column electrodes, selective writing data pulses having a pulse voltage in accordance with said pixel data, in synchronization with the application timing of each said priming pulse.

4. The plasma display panel driving method according to claim 1, further comprising the step of imposing priming discharge for causing priming particles to be formed in the discharge spaces of each said discharge cell, immediately preceding said selective erasing step.

5. A plasma display panel driving device for driving a plasma display panel, in which discharge cells bearing pixels are formed at each intersection point of a plurality of row electrodes corresponding to display lines and a plurality of column electrodes arranged so as to intersect said row electrodes, in a plurality of subfields constituting each field of a video signal, comprising:

an address component for setting each of said discharge cells either in an emission enable state or an emission disable state in accordance with the pixel data of each pixel based on said video signal, for each said subfield; and an emission sustain component for causing said discharge cells to emit light repeatedly in said emission enable state, wherein, when said discharge cells are in said emission disable state, said address component shifts said discharge cells to an emission enable state by selectively causing said discharge cells to perform a selective writing discharge in accordance with said pixel data, thus generating wall charges in said discharge cells; and, on the other hand, when said discharge cells are in said emission enable state, said address component causes said discharge cells to shift to an emission disable state by selectively causing said discharge cells to perform a selective erasing discharge in accordance with said pixel data, thus erasing the wall charges in said discharge cells.

6. The plasma display panel driving device according to claim 5, further comprising:

a reset component for setting all said discharge cells in said emission enable state by performing a reset discharge for all of said discharge cells only in the first subfield among said subfields of said field, immediately preceding said address step, thus causing wall charges to form in each said discharge cells; and an erasing component for setting all of said discharge cells in said emission disable state by performing an erasing discharge for all of said discharge cells only in the last subfield among said subfields of said field, immediately after said emission sustain step, thus erasing the charges existing in said discharge cells.

7. The plasma display panel driving device according to claim 5, wherein said address component further comprises:

a selective erasing component for imposing said selective erasing discharges by successively applying scanning pulses to said row electrodes, and applying, to said column electrodes, selective erasing data pulses having a pulse voltage in accordance with said pixel data, in synchronization with the application timing of said scanning pulses; and a selective writing component for imposing said selective writing discharges by sequentially applying priming pulses to each said row electrode, immediately before the application of each said scanning pulse, and applying, to said column electrodes selective writing data pulses having a pulse voltage in accordance with said pixel data, in synchronization with the application timing of each said priming pulse.

8. The plasma display panel driving device according to claim 5, further comprising a component for imposing a priming discharge in order to cause priming particles to be formed in the discharge spaces of each said discharge cell, immediately before said selective erasing discharge.

* * * * *